US006948845B2

(12) United States Patent
Journe

(10) Patent No.: US 6,948,845 B2
(45) Date of Patent: Sep. 27, 2005

(54) MECHANICAL TIMEPIECE

(76) Inventor: François-Paul Journe, 13, rue de la Cité, CH 201, Geneva (CH)

( * ) Notice: Subject to any disclaimer, the term of this patent is extended or adjusted under 35 U.S.C. 154(b) by 0 days.

(21) Appl. No.: 10/968,324

(22) Filed: Oct. 18, 2004

(65) Prior Publication Data

US 2005/0088918 A1 Apr. 28, 2005

(30) Foreign Application Priority Data

Oct. 28, 2003 (EP) ..... 03405772

(51) Int. Cl.[7] ..... G04B 15/00; G04B 19/20
(52) U.S. Cl. ..... 368/127; 368/142
(58) Field of Search ..... 368/76, 77, 124–128, 368/139–144, 220

(56) References Cited

U.S. PATENT DOCUMENTS 3,765,164 A * 10/1973 Esselborn ..... 368/190
3,974,639 A * 8/1976 Gilomen et al. ..... 368/142
5,838,641 A * 11/1998 Tohkoku et al. ..... 368/127
6,863,434 B2 * 3/2005 Mojon ..... 368/127
6,890,094 B2 * 5/2005 Dias ..... 368/127

FOREIGN PATENT DOCUMENTS

| | | |
|---|---|---|
| CH | 13248 | 6/1897 |
| CH | 21315 | 6/1901 |
| CH | 185199 | 7/1936 |
| DE | 280 774 | 11/1914 |

* cited by examiner

*Primary Examiner*—Vit W. Miska
(74) *Attorney, Agent, or Firm*—Sturm & Fix LLP

(57) ABSTRACT

A storage device comprises a first seconds wheel, engaging with a mainspring, and a second seconds wheel, a setting wheel for connecting these two seconds wheels, a yoke on which said setting wheel is pivotably mounted, the pivot axis of this yoke and that of the second seconds wheel being coaxial, a stop wheel kinematically linked with said first seconds wheel, a finger fixedly connected to said yoke, a storage spring for exerting upon said yoke a force tending to separate said finger from said stop wheel, whereas the force exerted upon said setting wheel by said mainspring serves to press said finger against said stop wheel, so that the latter is wound to the point where a tooth of said stop wheel abuts against said finger.

4 Claims, 1 Drawing Sheet

MECHANICAL TIMEPIECE

CROSS REFERENCE TO RELATED APPLICATIONS

This application is claims priority of European Application No. 03405772.9 filed Oct. 28, 2003, which is included in its entirety by reference made hereto.

BACKGROUND OF THE INVENTION

1. Field of the Invention

The present invention relates to a mechanical timepiece comprising an oscillator, the oscillating motion of which is maintained by a mainspring, in which a periodic energy storage device is disposed between this mainspring and an escapement associated with said oscillator.

2. Description of Related Art

The energy source for said mechanical timepieces is constituted by a mainspring constituted by a leaf spring wound in a barrel, its outer end being fixedly connected to the barrel drum, whereas its inner end is fixedly connected to the arbor of this barrel. Upon slackening, the mainspring drives the barrel drum. The latter has an external toothing engaging with the train of the timepiece, which toothing ends at the escapement intended to transmit the force of the mainspring to the regulator. With each turn of the hairspring, the latter trips a tooth of the escapement wheel, which, under the pressure exerted upon the train by the barrel spring, transmits to it an impulse serving to maintain the oscillation of the hairspring.

The force exerted by this mainspring upon the train is clearly not the same when this spring is fully wound or at the end of its winding. Consequently, the force transmitted by the escapement to the hairspring is not constant and the amplitude of the balance wheel varies, affecting its isochronism. Its period of oscillation will be shorter when the force is greater, whereas it will lengthen once this force diminishes.

Indeed, it has already been proposed to store energy temporarily between the barrel and the escapement in order to deliver a constant energy to the regulator system. The known devices to this effect can no longer be operated once the spring has been fully unwound, such that means have to be provided to stop the timepiece prior to complete unwinding of the mainspring so as to allow restarting of this timepiece after it has been rewound.

Moreover, these devices are not designed to be able to be housed in a watch, especially in a wrist watch, but are rather intended for clocks in which the problem of bulk does not have the same importance as in watches and particularly in wrist watches.

BRIEF SUMMARY OF THE INVENTION

The object of the present invention is to bring a solution to the problem of transmitting the force from the barrel spring to the escapement of a timepiece, by which solution the aforementioned drawbacks can, at least in part, be eliminated.

To this end, the subject of this invention is a mechanical timepiece as claimed in claim 1.

The appended drawing illustrates, diagrammatically and by way of example, an embodiment of the timepiece forming the subject of the present invention, provided with a periodic energy storage device.

DETAILED DESCRIPTION OF THE INVENTION

These figures show a part of the train of the timepiece. The first illustrated wheel of the customary train is the third wheel 1, the pinion of which meshes with the center wheel (not represented), itself provided with a pinion meshing with the toothing of the barrel containing the mainspring, as in all mechanical timepieces. This third wheel 1 is driven in the direction of the arrow $F_1$ and meshes with the pinion of a first seconds wheel 2 turning in the opposite direction shown by the arrow $F_2$.

Figure 1:
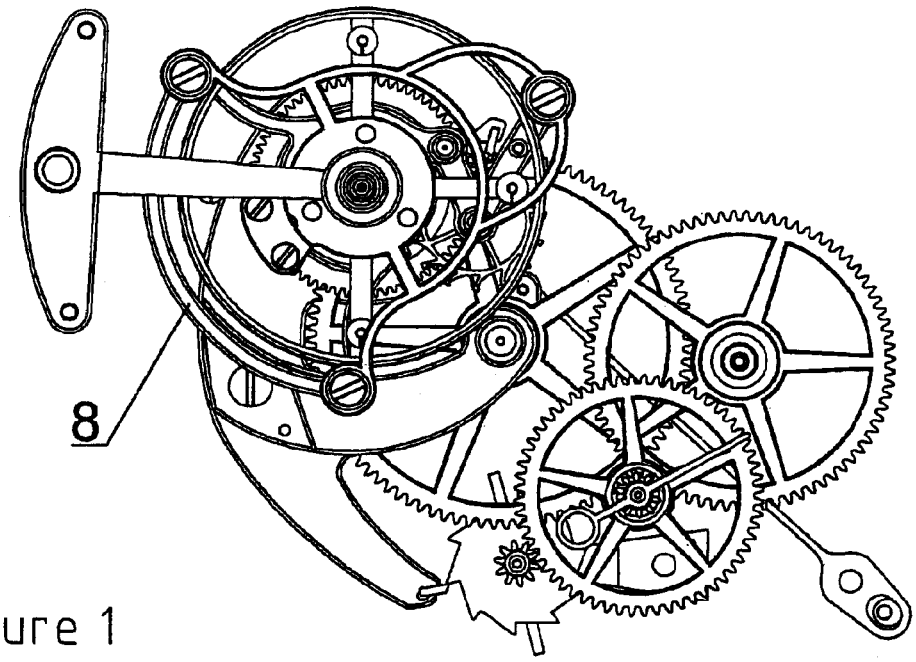
FIG. 1 is a partial plan view of this timepiece, more particularly, its part comprising the periodic energy storage device.
Figure 2:
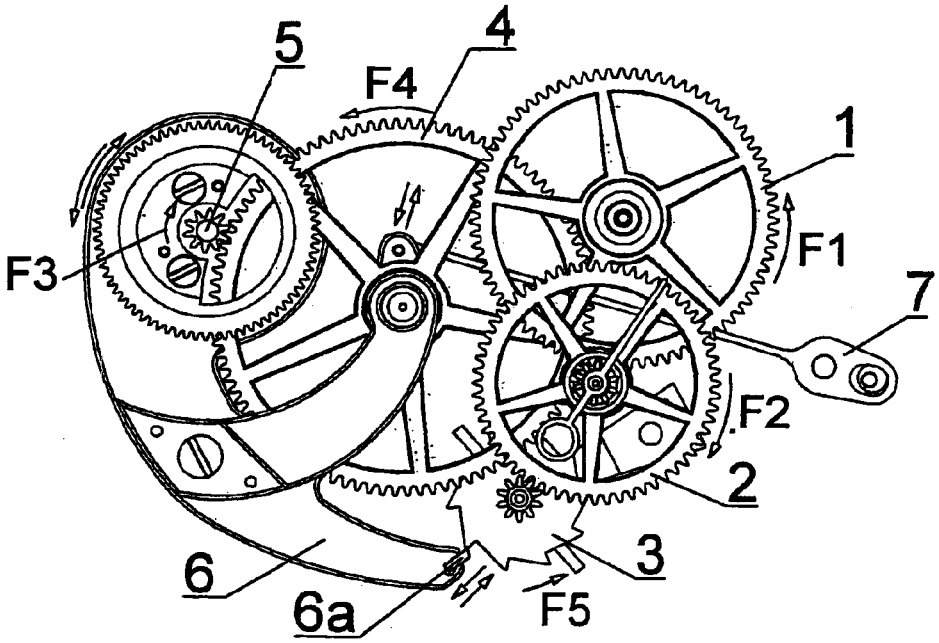
FIG. 2 is a plan view similar to FIG. 1, but without the tourbillon escapement.

The pinion of this first seconds wheel 2 meshes with a setting wheel 4, which itself meshes with the pinion of a second seconds wheel 5. In the embodiment illustrated by FIG. 1, the pivot pin of this second seconds wheel 5 is fixedly connected to a traditional tourbillion escapement 8, which there is no need to describe here insofar as it is not necessary to an understanding of the present invention. In another embodiment, the second seconds wheel 5 could mesh with the pinion of an escapement wheel of a traditional escapement.

The setting wheel 4 is pivotably mounted on an equality yoke 6, which is pivoted about an axis coaxial to the axis of the second seconds wheel 5. This equality yoke 6 is subjected to the force of a periodic energy storage spring 7, which tends to make it turn in the clockwise direction.

This equality yoke 6 has a finger 6*a* similar in this embodiment to a pallet stone of a pallet fork of an anchor escapement, intended to engage in a ratchet toothing of a stop wheel 3, the pinion of which meshes with the first seconds wheel 2.

The working cycle of the periodic energy storage device is as follows: when the pallet stone or the finger 6*a* of the equality yoke 6 is engaged with a radial flank of the ratchet toothing of the stop wheel 3, the train 1-3 is stopped, with the result that there is no longer any force transmission between the first seconds wheel 2 and the setting wheel 4.

During this stop period, which, in the described example, lasts one second, the force stored in the periodic energy storage spring 7 is released by turning the equality yoke 6 in the clockwise direction until the pallet stone or the finger 6*a* of this equality yoke 6 is disengaged from the radial flank of the stop wheel 3. During this displacement, the equality yoke 6 transmits its energy to the pinion of the second seconds wheel 5. Indeed, given that the first seconds wheel 2 is stopped, when the equality yoke 6 turns in the clockwise direction, the setting wheel 4 drives the pinion of the second seconds wheel 5 in the direction of the arrow $F_3$.

As soon as the pallet stone 6*a* of the equality yoke leaves the radial flank of the tooth of the stop wheel 3, the energy of the mainspring of the barrel is released. Given that the second seconds wheel 5 is controlled by the escapement 8, it can only turn when the escapement is displaced by the balance wheel, once with each turn of the latter. The second seconds wheel 5 can therefore be regarded as immobile during the passage from one tooth of the stop wheel 3 to the other, since this passage is virtually instantaneous. The setting wheel 4 therefore comes to bear upon the pinion of the second seconds wheel 5 and its driving in the direction of the arrow $F_4$ by the pinion of the first seconds wheel 2 pushes the pallet stone or the finger 6*a* of the equality yoke 6 against the inclined flank of one of the teeth of the stop wheel 3 turning in the direction of the arrow $F_5$, until it arrives against the radial flank of the following tooth. By following the inclined flank of the tooth of the stop wheel 3, the yoke is therefore displaced in the counterclockwise direction, bringing about the winding of the periodic energy storage spring 7, given that the force exerted by this storage spring 7 upon the equality yoke 6 is less than the force exerted upon this same yoke 6 by the barrel spring when the stop wheel 3 is released.

The cycle then recommences as previously described. With a periodic energy storage device of this type, the seconds hand borne by the first seconds wheel 2 moves forward in a jerk every second.

Of course, the winding and unwinding cycle of the equality spring 7 does not necessarily comprise one second. It could be lengthened or shortened by modifying the number of teeth on the stop wheel 3.

By virtue of this device, the escapement 8 only receives the energy stemming from the unwinding of the equality spring 7, which is independent of the degree of winding of the barrel spring. Hence, the amplitude of the oscillations of the balance wheel is independent of the force variations of the barrel spring, which allows improved isochronism of the balance wheel. It can be stated that the described storage device comprises a small number of parts.

What is claimed is:

1. A mechanical timepiece comprising an oscillator, the oscillating motion of which is maintained by a mainspring, in which a periodic energy storage device is disposed between this mainspring and an escapement associated with said oscillator, wherein this periodic energy storage device comprises a first seconds wheel engaging with said mainspring and a second seconds wheel engaging with said escapement, a setting wheel for connecting these two seconds wheels, a yoke on which said setting wheel is pivotably mounted, the pivot axis of this yoke and that of the second seconds wheel being coaxial, a stop wheel kinematically linked with said first seconds wheel, a finger fixedly connected to said yoke and the trajectory of which cuts that of said stop wheel, an energy storage spring for exerting upon said yoke a force tending to separate said finger from said stop wheel, whereas the force exerted upon said setting wheel by said mainspring serves to press said finger against said stop wheel with a force greater than that exerted by said storage spring, so that the latter is wound to the point where a tooth of said stop wheel abuts against said finger, allowing said storage spring to displace the yoke in the opposite direction in order to transmit its energy to said escapement up to the disengagement of said stop wheel, which, when it releases said first seconds wheel, allows the rewinding of said storage spring.

2. The timepiece as claimed in claim 1, in which the pivot pin of said second seconds wheel is fixedly connected to a tourbillion escapement.

3. A timepiece, in particular a wrist watch, as claimed in claim 1.

4. A timepiece, in particular a wrist watch as claimed in claim 2.

* * * * *